US005567892A

United States Patent [19]

Huang

[11] Patent Number: 5,567,892

[45] Date of Patent: Oct. 22, 1996

[54] MOTOR DRIVING ELECTRONIC MUSIC BOX

[75] Inventor: Lung-Hsi Huang, Taichung Hsien, Taiwan

[73] Assignee: Kyooh Precision Industry Co., Ltd., Taipei, Taiwan

[21] Appl. No.: 524,385

[22] Filed: Sep. 5, 1995

[51] Int. Cl.[6] ..... G10F 1/06

[52] U.S. Cl. ..... 84/95.2; 84/602

[58] Field of Search ..... 84/600, 601, 602, 84/94.1, 94.2, 95.1, 95.2

[56] References Cited

U.S. PATENT DOCUMENTS 5,157,217 10/1992 Feng ..... 84/95.2

5,264,656 11/1993 Huang ..... 84/600

*Primary Examiner*—Patrick J. Stanzione

*Attorney, Agent, or Firm*—Pro-Tector International

[57] ABSTRACT

A motor driven electronic music box with a motor in a motor base. The shaft end of the motor has a scroll gear to drive the gear train which connects to an output shaft to provide horizontal output. the crown wheel connects to the vertical output power from the gear shaft. One side of the motor base connects to a base, and the base includes a fixing ring with several sound holes. the fixing ring has aa clasp to fix a speaker. On the side of the base are several bosses to support a circuit board. The circuit board connects to the motor, the speaker, a power source, a switch and an LED. The integrated circuit on the circuit board causes the speaker to produce sounds, and the LED to flash according to the melody. The circuit acts on the output shaft and gear shaft at the same time.

5 Claims, 6 Drawing Sheets

MOTOR DRIVING ELECTRONIC MUSIC BOX

BACKGROUND OF THE INVENTION

1. Field of the Invention

The present invention relates to an electronic music box which is driven by a motor and electronically creates music.

2. Description of the Prior Art

A shown in FIG. 1, the conventional motor driven music box ha a cylinder structure 1 and a comb shaped scale springs 2. The rotation of the cylinder structure 1 contacting the scale spring creating sound. The melody is created by the projections on the cylinder. However, the conventional music box by the design of the cylinder structure, in that it can play only simple melodies. Also any one music box can have only one melody. A conventional music box can't emulate an integrated circuit sound synthesizer which can imitate 1) several melodies, 2) various animal sounds, 3) train sound and ambulance sound, and 4) various sounds of artificial phonetics. In contrast, the conventional motor driven music box has very little variation. It also can't drive an LED to flash according to the melody. Moreover, the conventional music box requires experts to design the cylinder structure and the comb shaped scale springs. It also requires high accuracy during production in order to create the correct melody. Thus, production costs are greatly increased. Additionally, if you want to extend the playing time, you need to match the limit-position switch 3 and the cylinder structure in order to make the cylinder rotate one cycle to turn off the limit-position switch. So, the conventional motor driven music box requires more components and higher cost.

SUMMARY OF THE INVENTION

The main purpose of the present invention is to provide a motor driven electronic music box which uses a motor as a power source as in the traditional music box, but eliminates the cylinder structure and the comb shaped scale springs. Instead, those components are replaced by an electronic circuit that provides a DC power supply and a simple circuit. Specifically, there is an integrated circuit to create the melody. When the DC power drives the electronic circuit, it can trigger the melody integrated circuit to play a complete melody through a speaker. Moreover, the melody integrated circuit can play different melodies through a speaker. Moreover, the melody integrated circuit can play different melodies or different sounds according to the desire of the user. The music box can also include LED components in the circuit and flash the LED according to the melody. Moreover, it can use gears and an output shaft to output power in order to create several motion combinations to drive toys. In contrast, the conventional music box uses power to drive the cylinder structure and the comb shape scale springs; thus the conventional music box only can play a fixed and uncompleted melody. Moreover, the present invention can include a clock with motion toy, and the switch can be eliminated by connecting the switch circuit directly to the clock mechanism. Therefore, the structure of the present invention can decrease production costs greatly, and also can produce special functions of sound, light and motion, thereby making it a very simple but high value product. The present invention can be used by toy, gift, and clock makers.

BRIEF DESCRIPTION OF THE DRAWINGS

The drawings disclose an illustrative embodiment of the present invention which serves to exemplify the various advantages and objects thereof and are as follows.

DETAILED DESCRIPTION OF THE PREFERRED EMBODIMENT

Figure 1:
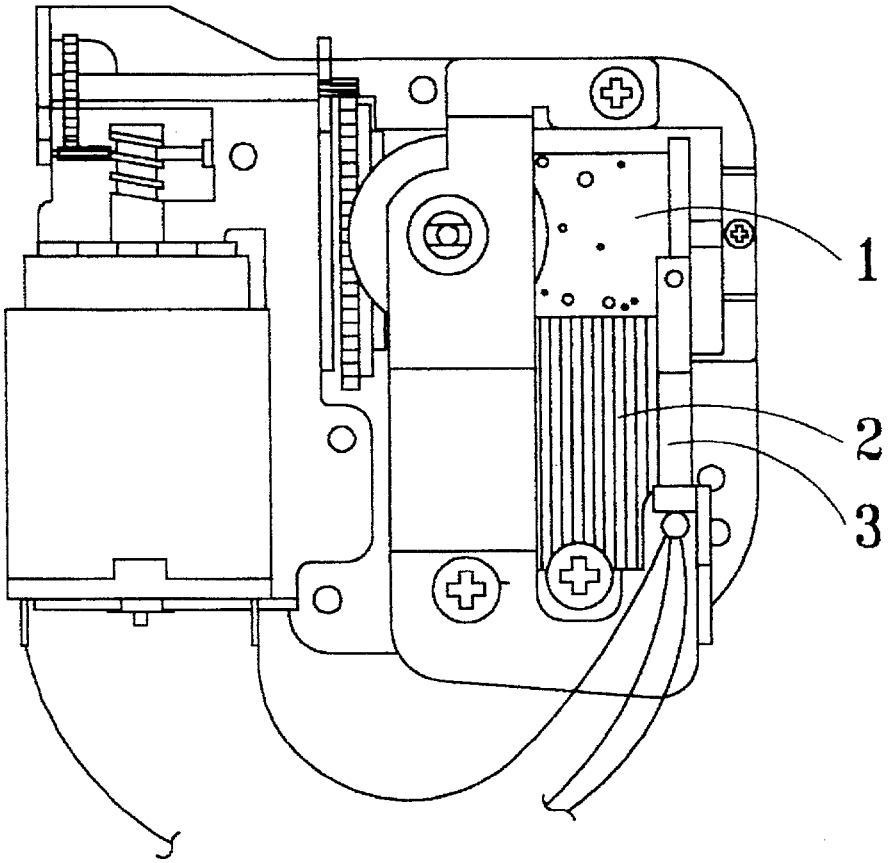
PRIOR ART FIG. 1
FIG. 1 is a top view of a conventional music box.
Figure 2:
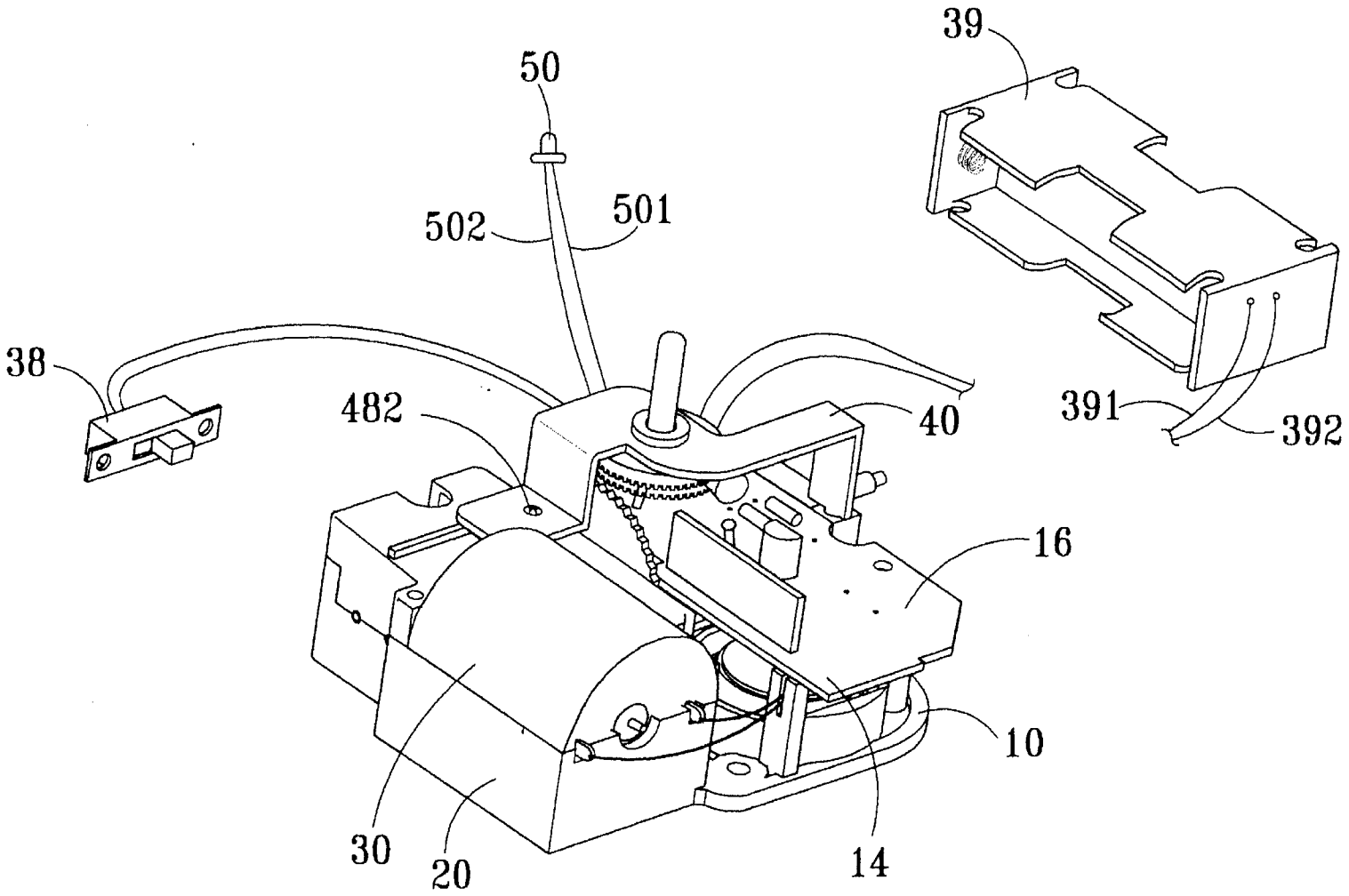
FIG. 2 is a perspective view of the present invention.
Figure 3:
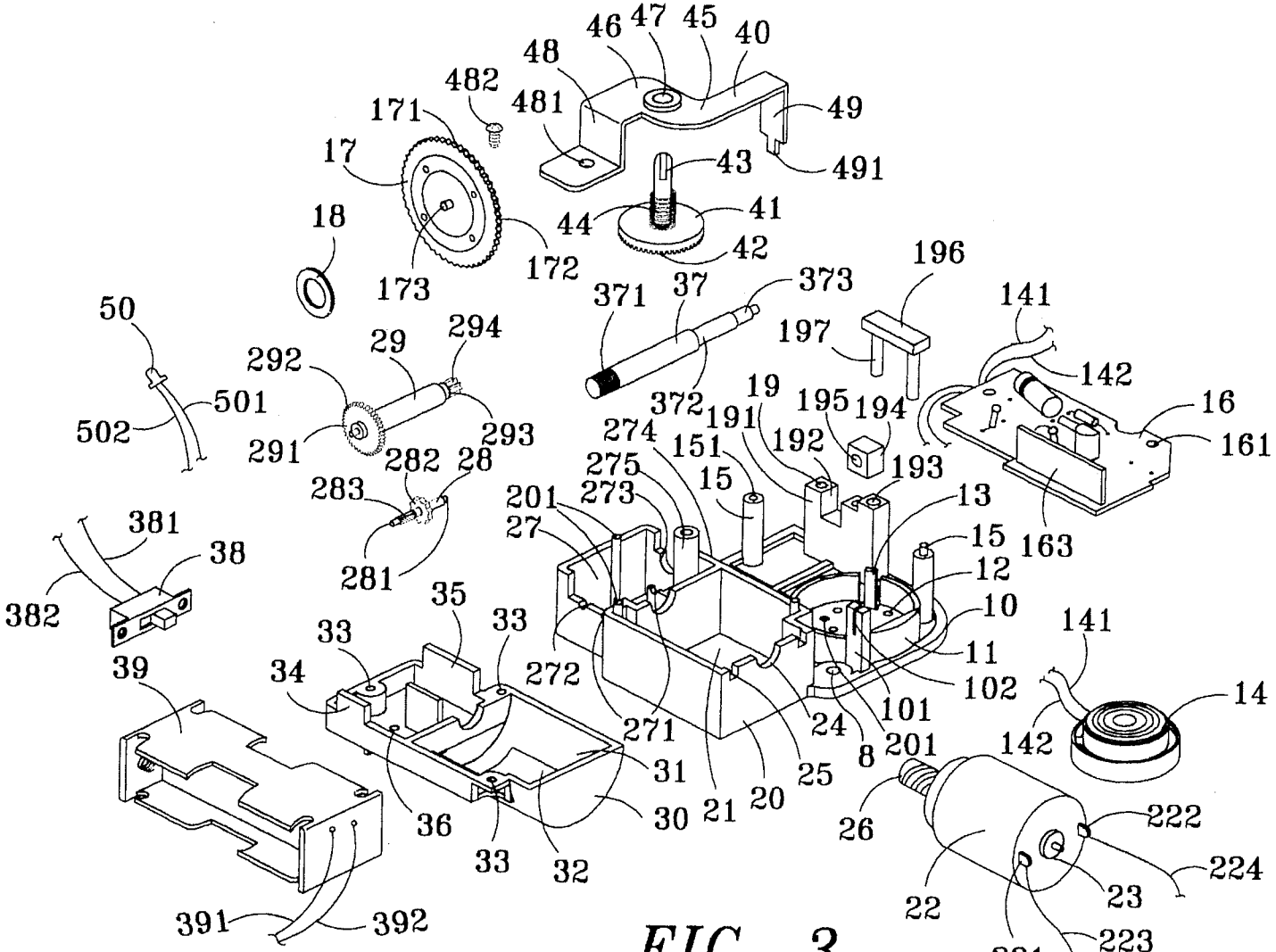
FIG. 3 is a perspective exploded view of the present invention.
Figure 4:
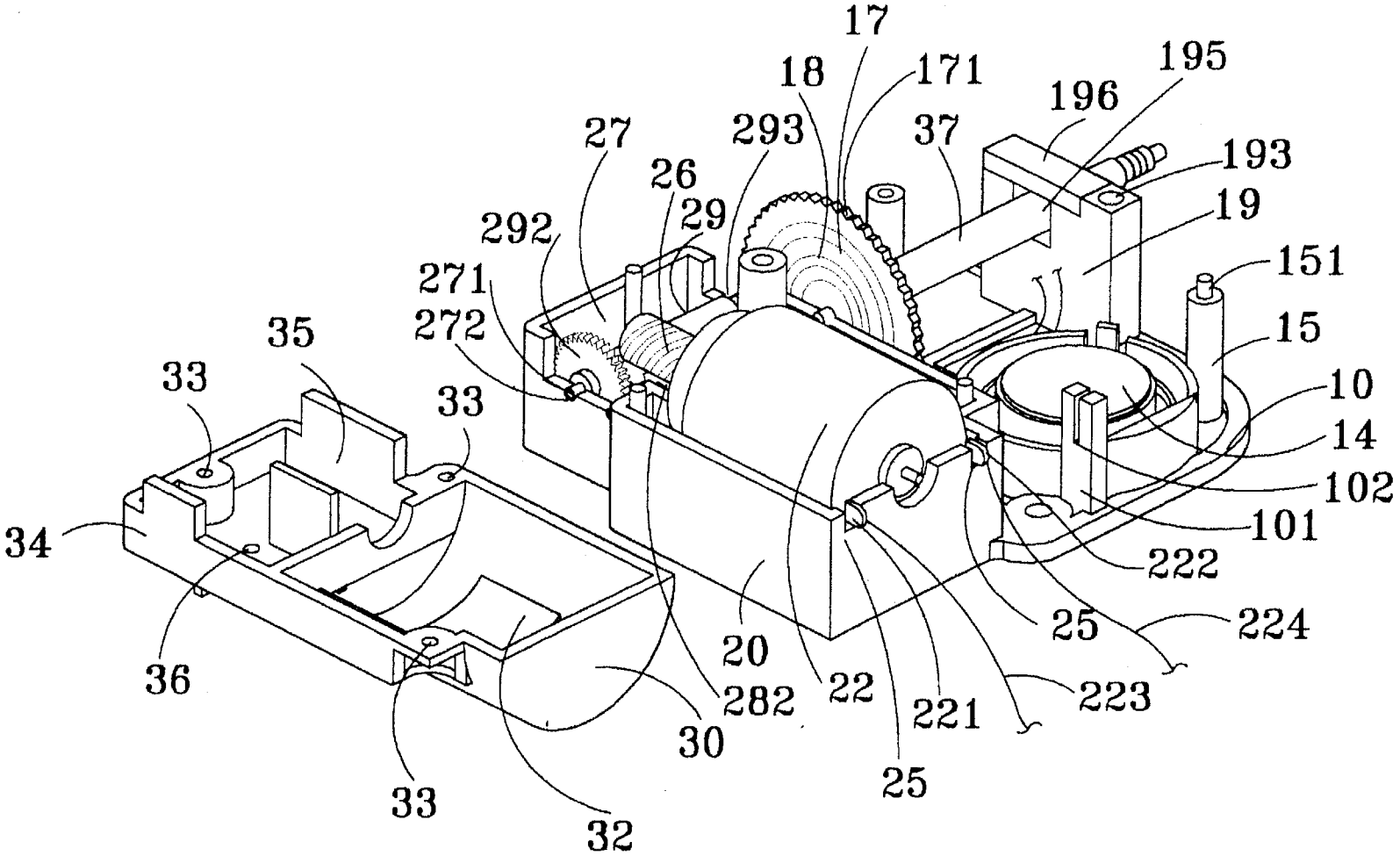
FIG. 4 is a perspective view showing the motor cover of the present invention.
Figure 4A:
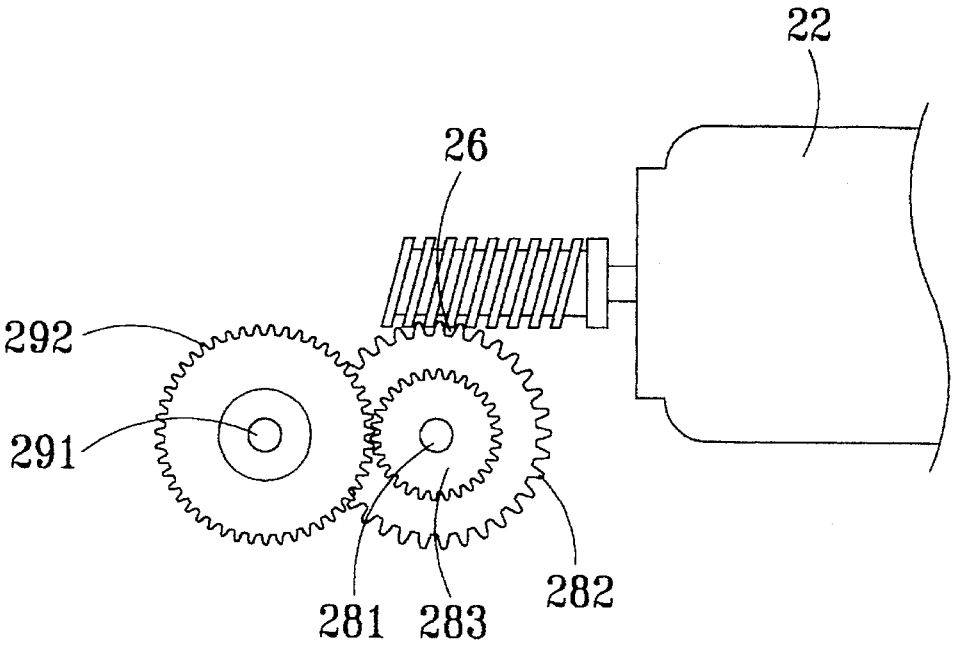
FIG. 4*a* is a side view of the motor output section of the present invention.
Figure 4B:
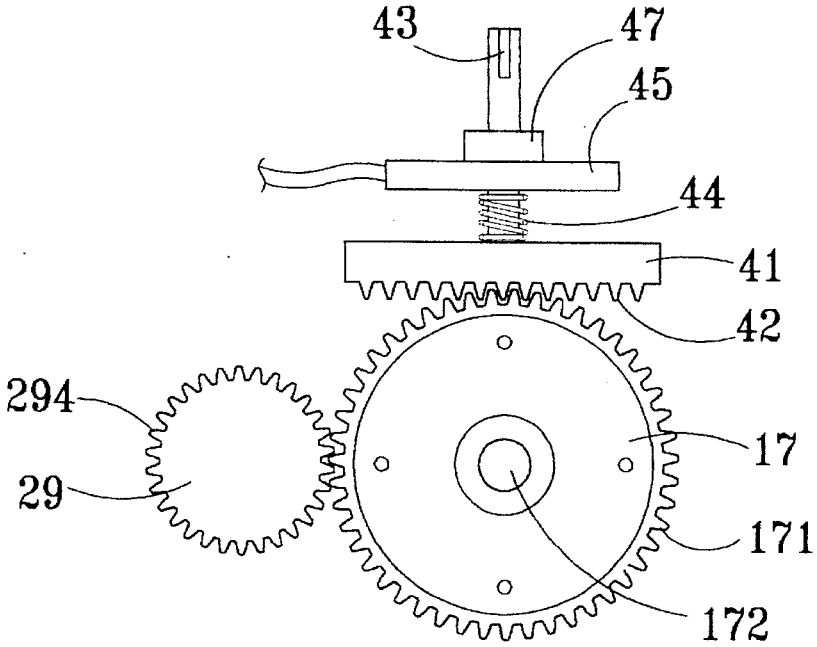
FIG. 4*b* is a side view of the vertical and horizontal power output sections of the present invention.
Figure 5:
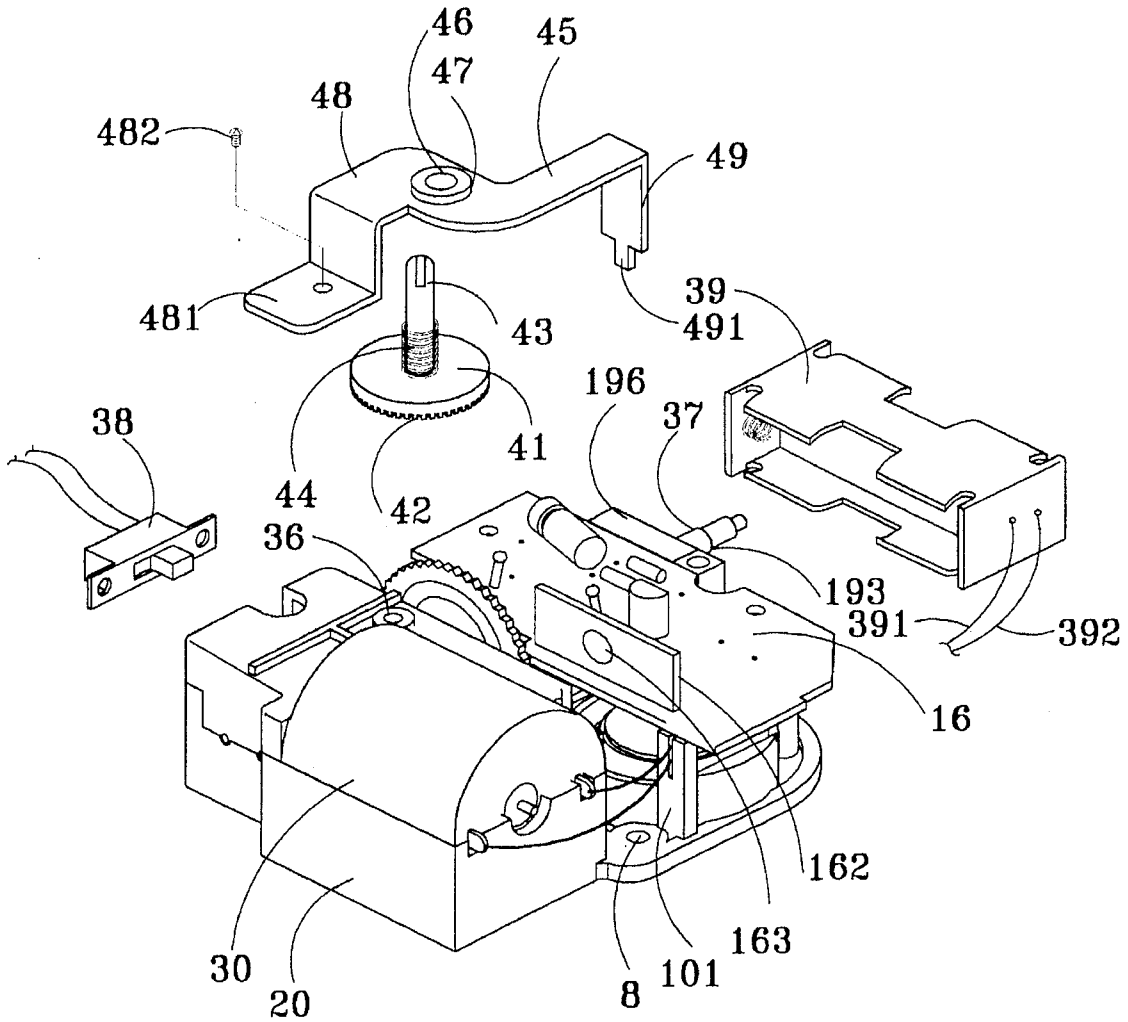
FIG. 5 is a partially exploded perspective view of the present invention.

Referring to FIG. 2 through 5, the present invention is a motor driven electronic music box comprising a base 10 and a motor base 20 which are formed from a plastic injected unit. The advantage of this structure is that it is lighter and produced faster than the conventional metal music box. The present invention doesn't need to have an additional process step to connect the base unit with the motor base.

The top of motor base 20 has a cover 30. In the motor vase 20 there is a motor cavity 21 to receive the bottom part of motor 22. The motor 22 has a shaft on each end. The shafts are received in the semi-circle shaft holes 24 which are on the front and back walls of motor cavity 21. The two terminals 221, 222 of motor 22 pass through the square holes 25 that flank the semi-circle shaft hole 24. The two terminals 221, 222 connect to the wires 223 224.

One end of the stub axle of the motor 22 connects to a scroll gear 26. The scroll gear 26 extends into the gear cavity 27 that connects with the motor cavity 21. In the gear cavity 27 there is a gear train which is composed of a first gear shaft 28 and a second gear shaft 29. In the gear cavity 27, near the wall of motor room 21 there are two shaft holes 271 that receive two terminals 281 of the first gear shaft 28. The gear teeth 282 on the middle part of the first gear shaft 28 mesh with the scroll gear 26.

The second gear shaft 29 has on a first end a terminal 291 that is inserted into the shaft hole 272 on the side of gear room 27. Next to the gear teeth 282 are a second set of gear teeth 283 that mesh with the gear teeth 292 of the second gear shaft 29. On a second end of the second gear shaft 29 there is a reducing part 293 which is inserted into the shaft hole 273 of the gear room 27 in order to extend the gear teeth 294 of the second end of the second gear shaft 29 out of the gear room 27 to the inside of the base 10.

The motor cover 30 has a semi-circular motor cavity 31 to hold the top section of motor 22. A sponge pad 32 cushions the motor 22. The two sides 34, 35 of motor cover 30 hold the two gear shafts 28, 29 in position in the gear room 27. On the motor base 20 are three bosses 201 that pass through the three holes 33 of the motor cover 30 and are riveted in place to fix the motor and the gear driving facility.

One side of the motor vase 20 connects to the base 10. On the front of the base 10, there is a fixing ring 11. In the ring cover area, there are several sound holes 12, and one clasp 13 to fix speaker 14 which has two wires 141, 142. On the side of the base 10 are several bosses 15. Each boss 15 has one protrusion 151 to match with the boring hole 161 of the circuit board 16 to install the circuit board on the top of support boss 101.

The circuit board connects separately to the speaker 14 (using wire 141, 142), a DC power source 39 (which is a battery holder using wire 391 and 392 to connect the pair of batteries in the battery holder), switch 38 (using wires 381, 382) and an LED component 50 (using wires 501, 502), the motor 22 (using wires 223 and 224 going through the square hole 103 of the support boss).

On one side of the base 10 is a connecting wall 19 which has a square concave opening 192. The square concave opening 192 receives the square shaft 194. The square concave opening 192 receives the square shaft 194. On the trop of connecting wall 19 are a pair of holes 191 that mate with the bottom end 197 of a clasp 196 in order to fix the square shaft 194.

On the inside wall of the gear cavity 27 of the motor vase 20 is a hole 274 to receive the mandrel 173 of gear 17. On the mandrel 173 is an arch shaped boarding spring 18 that fixes the gear 17. The other end of the gear 17 has a shaft hole 172 which receives the end 371 of the output shaft 37. The other side of output shaft 37 goes through the boring hole 195 which is on the square shaft 194. Also, the thinner end 372 of the output shaft 37 supports the boring hole 195 in order to have the thread end 373 output power horizontally. The output power depends on the side of the gear 17 meshing with the extended gear teeth 294 of the gear train to drive the gear train. The top of the gear 17 meshes with the gear teeth 42 of crown wheel 41 of gear stand 40. The top of the crown wheel joins a gear shaft 43 to output power vertically through a gear shaft 43 on which there is a spring 44.

The gear shaft 43 goes through the hole 46 of fixing rack 45. The spring is located between the crown wheel and the fixing rack 45 in order to create a better connection between the crown wheel 41 and the gear 17. Also, the fixing rack 45 uses an enhanced ring 47 to pivot with the gear shaft 43. One end of the fixing rack 45 is bend to form an L-shaped turning section 48, and uses screw 483 to go through the screw hole 481 on the turning section 48 and through the screw hole 36 on the motor cover 30 to join with the boss 275 of the motor case 20. Additionally, the other end of the fixing rack 45 turns downward to form a supporting section 49. The sharper end 491 of the supporting section 49 plugs into the hole of a protrusion of the connecting wall 19 in order to fix the fixing rack 45, the base 10, and the motor base 20.

After assembly of the components of the present invention, a music integrated circuit 163 is connected to the circuit board 16. The music integrated circuit 163 includes sound outputs which can create melody or other sounds. In addition, it can control the flash of the LED. When the switch 38 is turned on, the music integrated circuit on the circuit board will make sounds from the speaker 14, and the LED 50 will flash according to the melody. The output shaft 37 and the gear shaft 43 can connect to may different combinations to drive a toy. The type of toy can match with the type of melody that the music integrated circuit 163 will play. For example, if the sound the music integrated circuit is playing is a cat's sound, the toy can be designed as a cat.

Many changes and modifications in the above described embodiment of the invention can, of course, be carried out without departing from the scope thereof. Accordingly, to promote progress in science and the useful arts, the invention is disclosed herein and is intended to be limited only by the scope of the appended claims.

What is claimed is:

1. A motor driven electronic music box comprising;

a motor in a motor cavity between a motor base and a motor cover, and a shaft end of the motor meshes with a scroll gear to drive a gear train in a gear cavity situated between the motor base and the motor cover to connect to an output shaft to provide a horizontal output;

one side of the motor base connects to a base, and the base includes a fixing ring with a plurality of sound holes, the fixing ring has a clasp to fix a speaker;

the base includes several bosses to support a circuit board, the circuit board is connected to the motor and the speaker.

2. The music box as claimed in claim 1, wherein;

the circuit board is connected to at best one LED which flashes according to the melody.

3. The music box as claimed in claim 1, wherein;

the circuit board is connected to a battery box that provides a DC power source.

4. The music box as claimed in claim 1 wherein;

the integrated circuit produces a plurality of sounds and melodies.

5. The music box as claimed in claim 1, wherein;

the circuit board is connected to a switch that controls starting and stopping of melody and motion.

* * * * *